US006790378B2

(12) United States Patent
Graham et al.

(10) Patent No.: US 6,790,378 B2
(45) Date of Patent: Sep. 14, 2004

(54) COATING COMPOSITION HAVING MAGNETIC PROPERTIES

(76) Inventors: R. William Graham, 4352 Jonathan Dr., Kettering, OH (US) 45440; Daniel F. Peters, 7130 Liberty Fairfield Rd., Hamilton, OH (US) 45011; Charles E. Adams, 800 Sunnyview Ave., Dayton, OH (US) 45406; Ricky L. Helton, 8760 Charleston Hill Ct., Mason, OH (US) 45040

( * ) Notice: Subject to any disclaimer, the term of this patent is extended or adjusted under 35 U.S.C. 154(b) by 9 days.

(21) Appl. No.: 09/972,215

(22) Filed: Oct. 5, 2001

(65) Prior Publication Data

US 2003/0098436 A1 May 29, 2003

(51) Int. Cl.[7] ..... H01F 1/28

(52) U.S. Cl. ..... 252/62.53; 252/62.54; 428/694 B; 427/598; 427/599; 427/127; 427/128; 427/130

(58) Field of Search ..... 252/62.53, 62.54; 427/598, 599, 127, 130, 128; 428/694 B

(56) References Cited

U.S. PATENT DOCUMENTS

| | | | | | |
|---|---|---|---|---|---|
| 3,023,123 | A | * | 2/1962 | Colwill et al. | 427/130 |
| 3,428,603 | A | | 2/1969 | Kroenke et al. | 252/62.54 |
| 3,503,882 | A | * | 3/1970 | Fitch | 252/62.54 |
| 3,764,539 | A | | 10/1973 | Cochardt et al. | 252/62.54 |
| 4,278,556 | A | | 7/1981 | Tada | 252/62.54 |
| 4,308,155 | A | | 12/1981 | Tada et al. | 252/62.54 |
| 4,493,778 | A | * | 1/1985 | Iqbal | 252/62.54 |
| 5,002,677 | A | | 3/1991 | Srail et al. | 252/62.54 |
| 5,051,200 | A | | 9/1991 | Srail et al. | 252/62.54 |
| 5,112,403 | A | | 5/1992 | Okura et al. | 106/418 |
| 5,176,842 | A | | 1/1993 | Kuwazawa et al. | 252/62.54 |
| 5,567,757 | A | | 10/1996 | Szczepanski | 524/435 |
| 5,587,102 | A | | 12/1996 | Stern et al. | 252/62.54 |
| 5,609,788 | A | | 3/1997 | Deetz | 252/62.54 |
| 5,843,329 | A | | 12/1998 | Deetz | 252/62.54 |
| 5,916,641 | A | | 6/1999 | McArdle et al. | 427/487 |
| 5,990,218 | A | | 11/1999 | Hill et al. | 524/431 |
| 2003/0030027 | A1 | * | 2/2003 | Graham et al. | 252/62.54 |

FOREIGN PATENT DOCUMENTS

| | | |
|---|---|---|
| JP | 11-273938 | * 10/1999 |
| JP | 2001-35717 | * 2/2001 |

* cited by examiner

*Primary Examiner*—C. Melissa Koslow
(74) *Attorney, Agent, or Firm*—R. William Graham

(57) ABSTRACT

The present invention includes coating composition having magnetic properties for application to a substrate. The coating composition includes a plurality of strontium and or barium hexaferrite particles having a random magnetic pole alignment. The coating composition also includes a binder adhesive capable of suspending the strontium hexaferrite particles. The binder adhesive is a natural rubber capable of adhering in a substantially thin film to the substrate. The strontium hexaferrite particles are normally present between 50% to 98% of the coating composition's total weight when dried on the substrate. The thickness of the film of the coating composition ranges from 0.5 mils to 20 mils, and has 6 to 24 magnetic pole changes per linear inch. The binder adhesive allows for manipulation of the strontium hexaferrite particles to a non-random magnetic pole alignment after the ferromagnetic particles have dried in the binder adhesive on the substrate.

16 Claims, 1 Drawing Sheet

COATING COMPOSITION HAVING MAGNETIC PROPERTIES

FIELD OF INVENTION

This invention relates to the art of adhering a magnet to a substrate, and more particularly, the present invention relates to a coating composition having a random magnetic pole alignment able to be directly applied to a substrate, dried, and then aligning the magnetic poles such that the coating composition has a non-random magnetic pole alignment (aligned magnetic poles).

BACKGROUND

Traditionally, magnet compositions, made up of magnetic or magnetizable materials, (e.g., ferromagnetic material) and flexible resins have been used to form conventional flexible magnets by using several methods including compaction molding, injection molding, and extrusion molding.

The various methods used to produce flexible magnets include several complex, cost prohibitive steps. For instance, in compaction molding, a compound is packed in a press mold and compacted at a room temperature so as to form a green body. Subsequently, when the binding resin is a thermosetting resin, the resin is hardened, whereby a magnet is obtained. Extrusion molding is a method in which heated molten compound extruded from an extruder die is solidified by cooling and then cut at a desired length, whereby a magnet is obtained. In injection molding, a compound, which has been heated and molten to exhibit sufficiently high fluidity, is poured into a mold so as to form a magnet of a desired shape. Once the magnets are produced and readied for a particular substrate, there are several additional steps involved in adhering the magnet and the substrate together. For these reasons, it is desirable to apply a magnetizable coating directly to the substrate in one step.

In U.S. Pat. No. 3,503,882, Fitch disclosed a paint composition containing iron powder and an epoxy ester resin with an emulsifiable polyethylene wax and an organophilic alkyl ammonium bentonite dispersed in a paint hydrocarbon solvent when applied to a substrate and dried, a surface to which magnetic symbols will adhere and which will accept chalk markings. The iron powder employed in the oil-based paint formulation was rather coarse, at least 100 to 200 mesh, with over half preferably over 200 mesh, and comprising from about 70 to about 85% by weight, based on the combined weight of the iron powder and epoxy ester resin. Thus, the product was so coarse that it was brushed on, rather than rolled or sprayed, and fumes from the paint solvent are currently regarded as toxic.

In U.S. Pat. No. 5,587,102, Stem and Treleaven disclosed a magnetic latex paint composition comprising a carrier, particulate magnetically permeable material, a binder and a thickening agent having thixotropic and viscosity characteristics such that the paint composition has high viscosity characteristics when stationary, and low viscosity when shear forces to the paint as it is applied to a wall surface. Particulate iron no smaller than 350 mesh was employed with synthetic clay as a thickening agent to keep particles in suspension. Thus formulated, drying retarders were necessary so that a smooth surface after paint application could be achieved without lap marks. When the paint dried, magnetic objects could be mounted on the surface, held in place by the interaction with the magnetically permeable material.

While previous patents teach of magnetic paints and coatings, there fails to be a suitable magnetic coating composition capable of being suitably magnetized once dried on the substrate. The present invention provides a magnetic coating composition which improves upon the art.

SUMMARY OF THE INVENTION

It is an object to improve magnetic coating compositions.

It is yet another object to provide a relatively thin coating composition having magnetic properties which is inexpensive.

It is yet another object to provide a relatively thin coating composition having magnetic properties which is easy to apply to a substrate.

It is yet another object to provide a relatively thin coating composition having magnetic properties which includes high solids content while maintaining its flexibility.

The present invention includes coating composition having magnetic properties for application to a substrate. The coating composition includes a plurality of ferromagnetic particles having a random magnetic pole alignment and a binder adhesive capable of suspending the ferromagnetic particles. The binder adhesive is capable of adhering in a substantially thin film to the substrate. The binder adhesive allows for manipulation of the ferromagnetic particles to a non-random magnetic pole alignment after the ferromagnetic particles have dried in the binder adhesive on the substrate.

The coating composition having magnetic properties allows for the wet coating composition, having a simplistic binder adhesive formulation, to contain a relatively high percentage (such as 90–98% by weight of the dry coating composition) of ferromagnetic particles without the occurrence of clumping. Another advantage to a coating composition having magnetic properties is a user's ability to reasonably determine the degree of magnetization that he or she wishes to give the coating composition once dried on the substrate.

TERMINOLOGY

"Magnet" is a body, as a piece of iron or steel, that possess the property of attracting certain substances, as iron; a thing that attracts.

"Magnetize" is to make a magnet of; impart the properties of a magnet to; to exert an attracting or compelling influence.

"Magnetic pole alignment" as used herein means manipulating the magnetic poles of a ferromagnetic material.

DETAILED DESCRIPTION OF THE INVENTION

Figure 1:
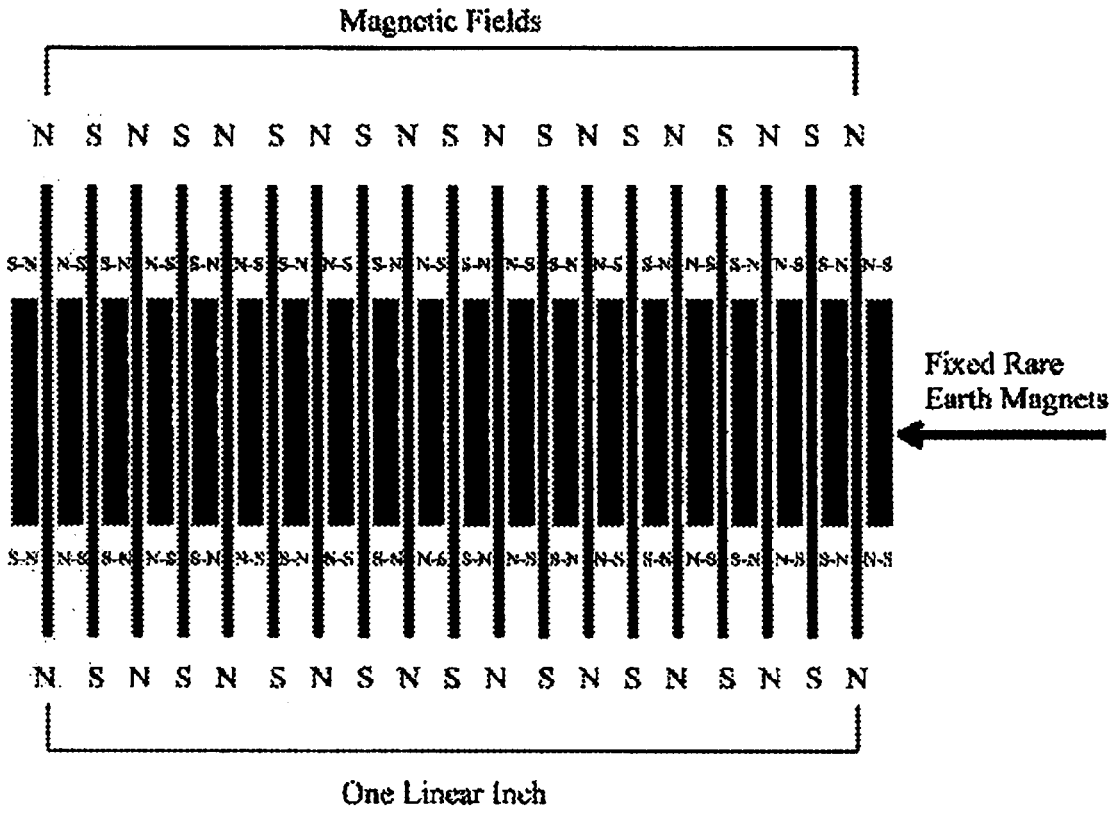
FIG. 1 is a representation of alternating pole alignment of the coating composition of the present invention.

The present invention consists of a coating composition having magnetic properties. The coating composition is made up of a ferromagnetic particles and a binder adhesive. This invention is based upon the finding that large quantities of certain ferromagnetic particles, having a random magnetic pole alignment, may be suspended by particular binder adhesives without clumping. The resulting coating composition is able to be applied to a substrate in a relatively thin film. Thin film as referred to herein is considered to have a thickness between 3 to 10 mils. The dried film is able to be manipulated to allow for the ferromagnetic particles to be magnetized, thus have a relatively non-random magnetic pole alignment.

Prior to further describing the invention, it is helpful to understand the problems faced and solved by the present invention.

Problems

Problems included a failure to understand how to:

- develop a thin magnetic coating which can be applied to virtually any substrate;
- provide a coating which must preferably be formulated as a printing ink with transfer properties, wherein transfer properties in printing inks means the ability to transfer from a holding reservoir to a pickup roll, and metered to a specific thickness, then transferred to the substrate;
- find a binder that can carry a very high loading of ferromagnetic material and still have printable newtonian properties, good flow and transfer in view of existing technologies for magnetic coatings which were unable to carry a sufficient loading of ferromagnetic material;
- find a ferromagnetic material that has inherent magnetic properties, but with each ferromagnetic particle having a random magnetic pole alignment; and
- find a ferromagnetic material that can be dispersed with a binder into a liquid mixture without affecting the ink properties.

Findings

Findings and solutions were that:

- coating compositions having less than 90 percent solids of ferromagnetic material in a dried film provide a very weak to no holding power in the thin coated substrate, thus a 90 percent solids (relatively high solids content of magnetic material and low solids content of binder) was required, yet the magnetic material could not deleteriously affect the ink;
- when the random magnetic pole alignment ferromagnetic magnetic ink is applied to the substrate and dried and it has no magnetic holding power at this point;
- the magnetic poles of the printed ink film can be aligned either before the substrate is cut or re-wound, or at any later time.

Strontium Hexaferrite and Barium Hexaferrite were selected ferromagnetic materials used in the manufacturing of the present invention. Strontium hexaferrite is superior to barium hexaferrite. Strontium hexaferrite is found to be more readily dispersed at high solids and magnetic pole alignment is more permanent.

A loading of ferromagnetic material by weight in the dried magnetic ink film must be in excess of 90 percent. A loading of less than 90 percent appears to have insufficient magnetic holding properties. An ink film thickness of 3 mil to 10 mil is necessary to achieve an adequate quantity of ferromagnetic material. An average film thickness of approximately 5 mil is suitable for most paper and unsupported substrates. At a 5 mil film thickness approximately 340.5 grams of ferromagnetic material is uniformly applied to 1000 square inches of substrate.

The magnetic coating has inherent magnetic properties, both in its liquid phase and in the dried film. It is not necessary to magnetize the coating. The magnetic fields of the ferromagnetic material must be physically oriented in a specific arrangement.

Single pole alignment of the magnetic material will not yield sufficient holding force. In other words, if all magnetic poles of the ferromagnetic material in the entire printed surface are aligned north/south, all in the same direction and the holding force is minimal.

Multiple/alternating magnetic pole alignment is necessary for good holding power. The poles of the magnetic material is alternatingly aligned north and south in narrow bands across the width of the printed surface as seen in FIG. 1. As few as 6 pole changes per linear inch will yield moderate magnetic holding power. Industrial multiple pole magnets are available for use in the present invention with up to 18 alternating pole alignments per inch. These industrial magnets yield 2 to 3 times the magnetic holding power of the laboratory 6 pole magnet in the printed ink film.

The ferromagnetic particles with random pole alignment of the preferred embodiment include strontium hexaferrite ($SrFe_{12}O_{19}$) and barium hexaferrite ($BaFe_{12}O_{19}$). However, some other ferromagnetic particles might be suitably intermixed or substituted, such as iron, nickel and cobalt compounds that have ferromagnetic capacity. For instance, most of the ferrites of the general formula MeO.Fe.sub.2 O.sub.3, in which Me is a metal, can be used as the magnet powder. Barium ferrite, BaO:6Fe.sub.2 O.sub.3, is a variation of the basic magnetic iron-oxide magnetite which has a hexagonal crystalline form and is very useful as the ferromagnetic particles. Barium ferrite can be magnetically aligned. It also has a very high uniaxial magnetic anisotropy capable of producing high values of coercive force (Hc). For a permanent magnet to retain its magnetization without loss over a long period of time, the coercive force should be as high as possible. Powdered strontium ferrite is also useful as the magnet powder. Alloys of nickel and iron, known as permalloy, have a maximum saturation magnetization in cases where the alloy contains about 50 percent nickel and 50 percent iron and are useful in powdered form as the ferromagnetic particles. The ferromagnetic particles will typically have a particle size which is within the range of about 0.1 to about 10 microns. The ferromagnetic particles will more typically have a particle size which is within the range of about 1 to about 5 microns.

In lieu of ferrite particles, the coating composition can contain rare earth magnet or magnetizable particles. By the term "rare earth magnet or magnetic material," it is meant any magnetic material or magnetizable material which contains at least one rare earth element therein, that is an element having an atomic number of from 57 to 71. Such elements can be contained in either minor or major amounts. Such rare earth magnets can contain minor or major amounts of non rare earth elements such as iron, cobalt, nickel, boron, and the like. Another definition of rare earth magnetic materials are compositions, that is alloys and/or mixtures, containing one or more rare earth elements which generally have good magnetic properties, that is magnetic properties such as generating a magnetic force which is greater than that obtained utilizing conventional non-rare earth magnets such as alloys of nickel, iron, and cobalt. Often times the residual induction value (B.sub.r) of the rare earth magnets is 25 percent greater than that generated by conventional non-rare earth magnet materials such as barium ferrite.

Rare earth magnets are described in various articles and especially in patents such as U.S. Pat. No. 4,496,395 to Croat, U.S. Pat. No. 4,558,077 to Gray, U.S. Pat. No. 4,597,938 to Matsuura et al., U.S. Pat. No. 4,601,875 to Yamamoto et al., U.S. Pat. No. 4,684,406 to Matsuura et al., European patent application No. 108,474 to General Motors, and European patent application Nos. 106,948 and 134,304 to Sumitomo Special Metals Company Ltd., all of which are hereby fully incorporated by reference with regard to the rare earth magnet compositions, methods of preparation, and the like disclosed therein and might be suitable for use in combination with the present invention.

A large class of rare earth magnet or magnetic materials are various alloys of iron, boron, at least one rare earth element, and optionally cobalt. Other rare earth magnet compositions are set forth in "Rare Earth Permanent magnets," E. A. Nesbitt and J. H. Wernick, Academic Press, New York, 1973, which is hereby fully incorporated by reference. Other rare earth patents are set forth in U.S. Pat. Nos. 4,869,964, 4,988,755, 5,051,200, and 5,173,206, which are hereby fully incorporated by reference with regard to all aspects thereof.

The amount of the rare earth magnet or magnetizable particles in the preferred embodiment is generally high, such that generally from about 50 to about 70 percent, desirably from about 58 to about 65 and preferably from about 55 to about 62 percent by volume can be utilized based upon the total wet volume of the rare earth particles and the binder adhesive. Ultimately, it is essential that the magnet or magnetizable particles used in the coating composition have a random magnetic pole alignment. In other words, it is essential that the magnet or magnetic particles used in the coating composition do not attract each other.

A binder adhesive of the preferred embodiment is natural rubber composition. In order to arrive at this, an evaluation of binders was made as follows.

Binder Evaluations:

Numerous binders with the following specifications were evaluated.

| | |
|---|---|
| Molecular weight ranges | 1500 to >10,000 |
| Acid Numbers | 50 to 250 |
| Tg | −40 deg C. to 105 deg C. |
| PH | 3 to 11 |

The binders used in the evaluation were both water dispersed and volatile organic solvent dispersed as applicable. All test formulations were comprised of mixtures to yield 90 plus percent by dry weight of ferromagnetic material in the dry ink film.

The test substrates used in evaluation were on 20# bond paper (copy machine paper) and 2 mil low density polyethylene (bread bag type plastic). Strontium hexaferrite was used in all evaluations, barium hexaferrite was found to yield an inferior holding power. The mixtures were applied with an anilox hand proofer and/or a metering bar.

The tested criterion for suitability are as follows:

1) Loading (ferromagnetic material to yield at least 90 percent by dry weight and for the mixture to remain fluid).
2) Adhesion to the test substrates.
3) Magnetic holding power with 6 alternating pole alignments per linear inch
4) Flexibility (bent back and fourth 90 degrees 10 times with no breaking)

If test number one failed, no further testing was done.

All tests are marked as either "P" for pass, "F" for fail, or "N" for no further testing. The binders evaluated and test results are as follows:

| Binder/Additive | Test #1 | Test #2 | Test #3 | Test #4 |
|---|---|---|---|---|
| 1) acrylic solutions (styrene acrylic Westvaco Chemicals Jonres H-2703) | P | F | N | N |
| 2) acrylic emulsions (styrene acrylic SC. Jonson Wax Joncryl 624) | F | N | N | N |
| 3) polyamide | P | P | P | F |

-continued

| Binder/Additive | Test #1 | Test #2 | Test #3 | Test #4 |
|---|---|---|---|---|
| 4) protein | P | F | N | N |
| 5) urethane | F | N | N | N |
| 6) rosin | P | F | N | N |
| 7) alkyd (#6504 EPS RESINS Inc.-Phthalic Acid/Glycol Alkyd) | F | N | N | N |
| 8) maleic (Arizona Checmical Beckacite 4904-Maleic Ester of Tall Oil) | P | N | N | N |
| 9) vinyl (Air Products Vancrvl 635 vinyl chloride | F | N | N | N |
| 10) phenolic (Arizona Chemical Sylva Print 9200 Alkylated Phenol in Either Acid reacted with Formaldehyde) | F | N | N | N |
| 11) shellac | F | N | N | N |
| 12) poly-vinyl alcohol | P | F | N | N |
| 13) poly-vinyl acetate (PVA) | P | F | N | N |
| 14) poly-vinyl chloride (PVC) | F | N | N | N |
| 15) thermoplastic (Rohm and Haas Acrvloid A-l 1 Methyl Methacrylate Acid) | F | F | N | N |
| 16) nitrocellulose | P | F | P | F |
| 17) melamine | F | N | N | N |
| 18) epoxy ester | F | N | N | N |
| 19) starch | F | N | N | N |
| 20) synthetic latex (Rohm and Haas Lucidine 135-Shellac Modified Polystyrene Latex) | P | P | P | F |
| 21) styrene maleic anhydride (SMA) | P | F | N | N |
| 22) polyvillidene chloride (PVDC) | F | N | N | N |
| 23) styrene butadiene latex acrylic co-polymer (SBR) | F | N | N | N |
| 24) natural rubber (Bondrite 428 ® - Natural Rubber Dispersed in VMP Naptha, Mineral Spirits and Hexane) | P | P | P | P |

Conclusion:

The only apparent suitable binder that passed all tests is natural rubber with the magnetic material employed. Strontium hexaferrite powder was found to be compatible with natural rubber. What appears unique about natural rubber is that it will sufficiently bind the strontium hexaferrite at very low natural rubber solids and very high strontium hexaferrite solids. The coating of natural rubber, strontium hexaferrite, and volatile solvents is easy to apply and dry. The magnetic poles of the strontium hexaferrite in the dried film readily accepts manipulation. The magnetic properties of the ink/coating are permanent once the magnetic poles are aligned. Some of the other binders evaluated can be added in small quantities as performance modifiers to the mixture. As example; urethane, styrene, melamine, nitrocellulose, or thermoplastic in small quantities will make the dried mixture harder. Example Formulas are as follows:

Formula #21 (Natural Rubber) Mixture:

| | |
|---|---|
| Hexane | 11.200 |
| Cycloparaffin | 6.000 |
| Heptane | 18.000 |
| Mix and Add While Mixing | 4.800 |
| Natural Rubber | |
| Mix and Add Slowly While Mixing | 50.000 |

-continued

| | |
|---|---|
| Strontium Hexaferrite | |
| Mix and Add as Needed for Viscosity Control | 10.000 |
| Hexane | |
| | 100.000 |
| A simplified formula for this mixture is as follows: | |
| BONDRITE 428 ®, including natural rubber and resin | 40.000 |
| Add Slowly While Mixing | 50.000 |
| Strontium Hexaferrite | |
| Mix and Add as Needed for Viscosity Control | 10.000 |
| Hexane | |
| | 100.000 |

These formulas yield 91.25 percent of strontium hexaferrite in the dried ink film. These formulas can be adjusted in the natural rubber, strontium hexaferrite, and solvent percentages for flexibility, viscosity, and strontium hexaferrite loading (for magnetic holding power). Additionally, other solvents (glycols, glycol ethers, acetates, ketones and the like) may be use to adjust the drying speed of the printed magnetic ink film. Alcohols were found problematic in the natural rubber mixture. Alcohols tended to increase the viscosity of the mixture(s) in an uncontrollable manner.

The natural rubber can be dispersed in one of heptane, hexane, and acetone. The natural rubber can also be dispersed in ethyl acetate.

In further conclusion, no prior existing technologies allow the high solids loading of ferromagnetic material (strontium hexaferrite). It was also found that strontium hexaferrite loadings as high as 98 percent by weight are possible. Although with 98 percent strontium hexaferrite solids the ink/coating film was brittle. A 98 percent loading appears practical for a non-flexible application.

The contents of the natural rubber composition may vary depending upon the desired use of the invention. For instance, commercial applications would require a fast drying version of the invention. The contents of the natural rubber composition would preferably include natural rubber dispersed in synthetic, organic, and hydrocarbon solvents and diluents. Alternatively, for non-commercial applications, a slow drying version of the invention would suffice. The contents of the water-based composition would preferably include synthetic and or natural resins, water, amines, surfactants, solvents, and diluents.

There are various methods of applying the coating composition to a substrate. For instance, the coating composition may be applied using rollers, brushes, squeeze tubes, spatulas, injection devices, and all such related devices. The application(s) may result in a thin film of the coating composition. Additionally, it is foreseen, especially for non-commercial use, that the coating composition could be packaged in tubes or cans. The coating composition may be applied at room temperature.

Examples of general substrates which the coating composition may be applied to include paper, plastic, cloth, leather, wood, metal, glass, synthetic composites, organic composites, and like such materials. More specifically, the coating composition may be applied to business cards, signs, labels, photographic paper, stencils, and like such materials.

The coating composition does not need to be dried on the substrate before non-random magnetic pole field alignment can achieved. However, a dried film is preferred for ease of machining or handling. Most conventional methods of drying or baking will work. The substrate with the dried and leveled coating composition is then passed over either fixed magnets or electromagnets. The greater the number of magnetic pole changes per linear inch increases the magnetic holding properties of the finished product. The minimum number of magnetic pole changes per linear inch is about 4. Although, about 8 to 12 magnetic pole changes per linear inch is recommended for adequate magnetic holding power. The maximum pole changes per linear inch, with current available technology, is about 32. The holding power of the coating composition may be such that the coating composition is used for holding the weight of the coating composition, as well as the substrate to which it is adhered, in a removable substantially fixed position to a surface, in opposition to gravitational force. However, when the substantially fixed position is not in opposition to gravitational force, the coating composition may serve the function of holding a substrate in a removable substantially fixed position against the external forces applied to the substrate during its intended use (e.g., the forces exerted on carpet by the person walking on the carpet or shelf liner on a metal shelf).

Beyond holding power, it is understood the coating composition may be magnetized for the purpose of communicating information (e.g., magnetizable credit card strips to be read by a reading device, magnetizable security strips capable of tripping an alarm, etc.) Additionally, it is foreseen that commonly painted strips in the middle of a road may be magnetized to provide information to vehicles.

The thickness of the coating composition may be built up by the application of multiple coats or layers. Minimum thickness of the coating composition is determined by the number of magnetic field pole changes per linear inch, the percent by volume or weight of the ferromagnetic material, and the substrate.

For instance, the thickness of the coating composition may range from 0.5 mils to 20 mils. It should be understood that the previously mentioned range is not meant to limit, but to illustrate a range of common thickness for some applications. It is foreseen that a coating composition may be greater or less than the range previously stated.

The coating composition should be made to a uniform thickness. Uniform thickness of the coating composition can be achieved by the use of rollers, nip rollers, bars, doctor blades, buffing, burnishing, sanding, or any such related method. It is understood that the coating composition may be applied to form a continuous film or coating, as well as a non-continuous film or coating. A non-continuous film or coating may be in a non-random or random pattern.

Additionally, it is foreseen in a single continuous process that a removable adhesive may be applied to the dried coating composition by conventional coating methods. The adhesive would be similar, but not limited to the adhesive used on POST-IT®notes, such adhesives are tacky adhesives well known in the art. A release liner sheet would be applied on top of the adhesive. With this configuration of construction, this product would adhere to ferrous surfaces by magnetic attraction and by removing the release liner sheet the product would adhere to non-ferrous surfaces.

The invention will be better understood by reference to the following examples which serve to illustrate but not to limit the scope of the present invention. Physical magnet configuration diagram used to align magnet fields of ferromagnetic material.

EXAMPLES

Example 1

| Wet Form | | |
|---|---|---|
| BONDRITE 428 ®, including natural rubber and resin, | 35–40% by weight | 11–13% solids |
| Strontium Hexaferrite | 60% by weight | 100% solids |
| Heptane | 0.0–5% by weight | 100% volatile |

Example 2

| Wet Form | | |
|---|---|---|
| BONDRITE 428 ®, including natural rubber and resin, | 35–40% by weight | 11–13% solids |
| Strontium Hexaferrite | 60% by weight | 100% solids |
| Ethyl acetate | 0.0–5% by weight | 100% volatile |

While the present invention has been described in detailed embodiments, it will be appreciated and understood that modification may be made without departing from the true spirit and scope of the invention.

What is claimed is:

1. A coating composition having magnetic properties for application to a substrate, said coating composition comprising a relatively high solids content of ferromagnetic particles having a random magnetic pole alignment; and a binder adhesive including natural rubber capable of one of dispersing and suspending said relatively high solids content of said ferromagnetic particles with relatively low solids content of said binder adhesive, wherein said ferromagnetic particles range between 90% to 98% of said coating composition's total weight, said binder adhesive capable of adhering to the substrate wherein said binder adhesive allows for manipulation of said ferromagnetic particles to a non-random magnetic pole alignment after said ferromagnetic particles have been applied in said binder adhesive on the substrate and wherein said binder enables said composition to maintain fluidity when wet.

2. The coating composition having magnetic properties of claim 1, wherein said coating composition is capable of holding the substrate in a removably fixed position to a surface.

3. The coating composition having magnetic properties of claim 2, wherein said coating composition is able to removably fix to substrate to aid surface in opposition to gravitational force.

4. The coating composition having magnetic properties of claim 2, wherein said coating composition is able to removably fix the substrate to said suite in position to forces consistent with the substrate's use.

5. The coating composition having magnetic properties of claim 1, wherein said composition is capable of retaining information in the form of a particular sequence of non-random pole alignments.

6. The coating composition having magnetic properties of claim 1, wherein said composition is formulated to be able be able to form a film onto substrate having a thickness between 3 and 10 mils.

7. The coating composition having magnetic properties of claim 1, wherein said ferromagnetic particles are at least one of strontium hexaferrite and barium hexaferrite.

8. The coating composition having magnetic properties of claim 1, wherein said binder adhesive is a combination including at least one natural rubber, at least one solvent and at least one diluent.

9. The coating composition having magnetic properties of claim 1, wherein said binder adhesive is a combination including at least one natural rubber, at least one resin, at least one amine, at least one solvent, at least one diluent, and water.

10. The coating composition having magnetic properties of claim 9 wherein said natural rubber is dispersed in one of heptane, hexane, and acetone.

11. The coating composition having magnetic properties of claim 9, wherein said natural rubber is dispersed in ethyl acetate.

12. The coaxing composition having magnetic properties of claim 1 wherein said coating composition is formulated to have 6 to 24 magnetic pole changes per linear inch.

13. A method of applying a coating composition having magnetic properties to a substrate, said method comprising (a) applying a coqting composition comprising a relatively high solids content of ferromagnetic particles having a random magnetic pole alignment, a binder adhesive capable of one of dispersing and suspending said relatively high solids content of said ferromagnetic particles, said binder adhesive capable of adhering to the substrate, wherein said binder adhesive allows for manipulation of said ferromagnetic particles to a non-random magnetic pole alignment after said ferromagnetic particles have dried in said binder adhesive on the substrate to the substrate; and (b) passing a device over said film of said coating composition, said device capable of aligning said poles of said ferromagnetic particles such that said ferromagnetic particles have at least a partially non-random magnetic pole alignment wherein said binder includes natural rubber.

14. The method of claim 13, wherein said step (a) is characterized by applying a substantially thin film of said coating composition onto said substrate.

15. The method of claim 13, which further includes the step of drying said coating composition, such that said plurality of ferromagnetic particles are substantially evenly dispersed throughout said film prior to step (b).

16. The method of claim 13, which further includes applying a removable adhesive to said dried coating composition having at least a non-random magnetic pole alignment.

* * * * *